United States Patent [19]

Fridl et al.

[11] 4,398,491

[45] Aug. 16, 1983

[54] ACOUSTIC INDICATOR OF VACUUM LEVEL IN CONTAINERS

[75] Inventors: James J. Fridl, Darien; Heinz W. Nonnemann, Palos Park; Robert D. Payne, Countryside; Wesley J. Szpitalak, Palos Park, all of Ill.

[73] Assignee: The Continental Group, Inc., Stamford, Conn.

[21] Appl. No.: 270,066

[22] Filed: Jun. 3, 1981

[51] Int. Cl.[3] ..... G08B 3/00; B65D 51/24; G10K 5/00

[52] U.S. Cl. ..... 116/67 R; 116/137 R; 46/179; 206/459; 206/829; 215/262; 220/231; 220/359; 220/373

[58] Field of Search ..... 46/175 R, 179; 206/459, 206/524.8, 829; 215/262; 116/137 R, 67 R; 73/49.3, 52; 220/260, 271, 359, 367, 373, 374, 231

[56] References Cited

U.S. PATENT DOCUMENTS

| | | | |
|---|---|---|---|
| 999,567 | 8/1911 | Kallstrom | 116/137 R |
| 1,943,834 | 1/1934 | Meneghetti | 116/70 |
| 2,708,895 | 8/1954 | Ward | 116/137 R |
| 2,721,533 | 8/1953 | Alderfer | 116/137 R |
| 2,764,121 | 2/1954 | Showstack | 116/137 R |
| 2,782,747 | 4/1955 | Alderfer | 116/137 R |
| 2,798,452 | 8/1955 | Baer | 116/137 R |
| 3,230,661 | 1/1966 | Gleason | 116/67 R X |
| 3,369,689 | 9/1964 | Dodge | 215/262 |
| 3,459,218 | 3/1967 | Cranage | 116/137 R |
| 3,930,592 | 1/1976 | Dilanni | 116/70 |
| 4,051,973 | 6/1976 | Botkin | 215/260 |
| 4,277,300 | 7/1978 | Taluba | 46/179 |

*Primary Examiner*—E. R. Kazenske
*Assistant Examiner*—J. Chapman
*Attorney, Agent, or Firm*—Charles E. Brown

[57] ABSTRACT

This relates to the provision of a vacuum indicator in a container wherein a product is vacuum packaged. Most specifically, an end unit for a conventional container is provided with a vent opening through which air rushes into the container when opened. There is secured to the underside of the end unit a whistle device in communication with the opening so that the inwardly rushing air actuates the whistle device and causes the whistle device to emit a whistling sound in accordance with the vacuum present within the container and thereby gives an audible indication of the freshness of the product.

9 Claims, 4 Drawing Figures

ACOUSTIC INDICATOR OF VACUUM LEVEL IN CONTAINERS

This invention relates in general to new and useful improvements in containers and components thereof, and more particularly to a container which is particularly adapted for packaging of a product under vacuum conditions.

When a long shelf life is desired or because of the peculiarities of the product being packaged, certain products are packaged within sealed containers under vacuum conditions. While such products may be packed under the desired vacuum conditions, because of the existence of certain minute leaks, it is possible that the vacuum be greatly diminished before the product is purchased off of the shelf. However, the purchaser has no way of determining the extent of the vacuum until he opens the container, and even then he cannot tell the extent of the vacuum except by the general sound of the inrushing air. Thus, the purchaser has no way of determining the state of the vacuum within the container.

It has been known in the past to form end units with the end panels thereof constructed so that when the vacuum within the container is relieved, the end panel will flex with a positive click so as to indicate the existence of a vacuum within the container. This type of indicator has not proved to be fully satisfactory.

It is also known to provide whistles which operate in response to the flow of air therethrough. However, in the past such whistles have never been associated with vacuum packed containers.

In accordance with this invention, it is proposed to provide the end panel of an end unit for a container with an opening therethrough and to secure to the underside of such panel in communication with the opening a suitable whistle device. The opening will normally be closed by a removable closure and when a purchaser of such a vacuum packed product is ready to open the product, he may move the closure to a position wherein the opening is uncovered and air will be free to rush into the container through the opening, thereby actuating the associated whistle device, provided, of course, that there was sufficient vacuum remaining within the container. The provision of such a whistle device permits one to know in advance of the complete opening of the container as to whether or not the required vacuum has been maintained within the container.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
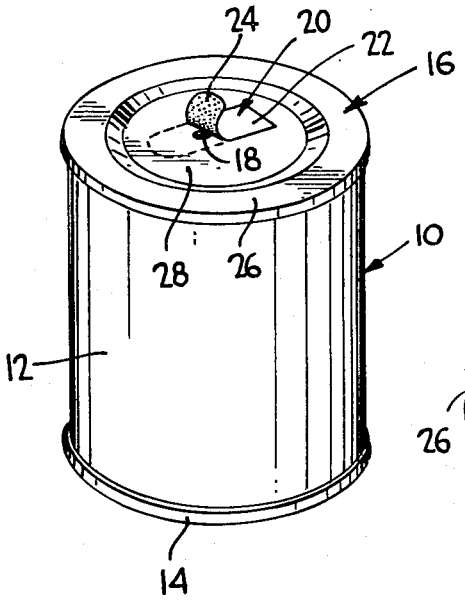
FIG. 1 is a perspective view of a container formed in accordance with this invention, and shows the removable closure in a position uncovering the vent opening.

Referring now to the drawings in detail, it will be seen that there is illustrated in FIG. 1 a container of a conventional vacuum pack type, the container being generally identified by the numeral 10. Although the container 10 may vary, at least for purposes of illustration the container 10 includes a tubular body 12 which has the lower end thereof closed by a bottom end unit 14. The upper end of the container body 12 is closed by an upper end unit generally identified by the numeral 16. It is to be understood that a suitable product, such as nuts, coffee, etc., will be packaged within the container 10 under preselected vacuum conditions.

The container 10 differs from existing vacuum packed containers in the construction of the end unit 16. The end unit 16 has a central opening 18 therethrough which opening functions as a vent opening. The opening 18 is normally closed by way of a removable closure 20. The closure 20 is preferably in the form of a length of tape having one end portion 22 permanently bonded to the end unit 16 and the opposite end of the tape designated by the numeral 24 free of securement to the end unit 16. An intermediate portion of the tape 20, which overlies the opening 18, is peelably bonded to the end unit 16.

While the end unit 16 has been illustrated as having a recessed end panel 26 including a recessed central portion 28 in which the opening 18 is formed and the closure 20 is recessed, it is to be understood that other end panel configurations may be utilized.

Figure 2:
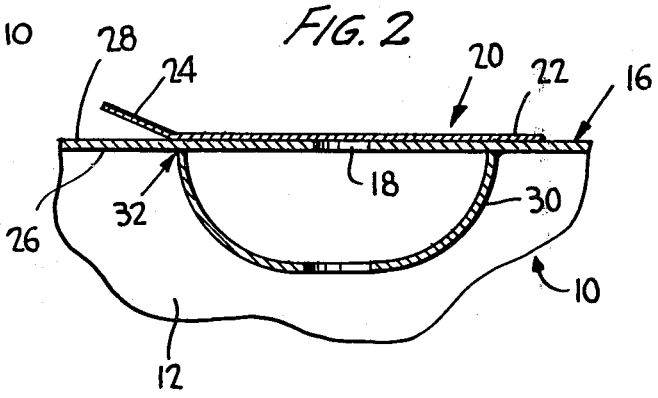
FIG. 2 is a fragmentary vertical sectional view taken through the end panel of the end unit of FIG. 1, and shows associated therewith one form of whistle.

Referring now to FIG. 2, it will be seen that there is illustrated the specific details of the end unit 16 including a whistle device 30. The whistle device 30 is suitably bonded as at 32 to the underside of the end panel 26 in alignment with the vent opening 18. The vent opening 18 is normally closed by the tape 20. It is to be understood that a vacuum has been drawn within the container 10 surrounding the whistle device 30 and that the product is so packed within the container 10 that air is free to flow through the whistle device 30.

It will be readily apparent that when the tape 20 is peeled relative to the end panel 26, the vacuum within the upper part of the container 10 will serve to draw air rapidly into the container 10 through the opening 18 with the flow of air and the rate of flow being such as to actuate the whistle device 30 and produce an audible noise which will indicate to the person opening the container that the product remains packaged at the selected vacuum. If no whistle noise is heard or if the whistle is weak, this would serve as an indicator to the purchaser that the product has not been maintained packed at the desired level of vacuum, and therefore the product may not be as fresh as desired. On the other hand, a loud whistling noise would indicate to the purchaser that the vacuum level has been maintained and the product is fresh.

Figure 3:
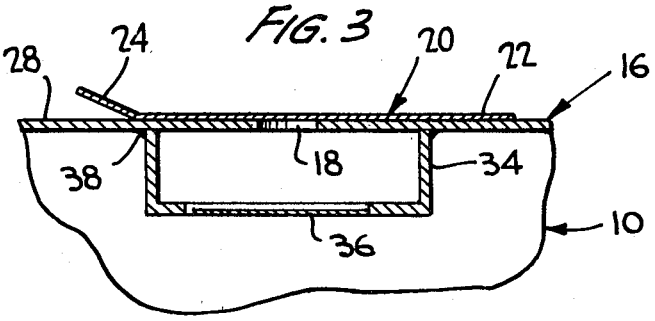
FIG. 3 is a fragmentary vertical sectional view similar to FIG. 2, and shows another form of whistle.

Reference is now made to FIG. 3, wherein the end unit 16 is provided with a modified form of whistle device 34. The whistle device 34 is of the vibrating reed type and includes a reed 36. The whistle device 34 is sealed to the underside of the recessed portion 28 of the end unit end panel as at 38. The function of the whistle device 34 is the same as that of the whistle device 30, although the audible sound emitted thereby when the container is opened may be different.

Figure 4:
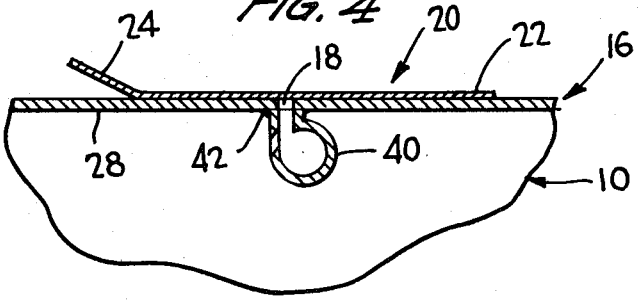
FIG. 4 is another fragmentary vertical sectional view similar to FIG. 2, and shows the utilization of yet another form of whistle.

Reference is now made to FIG. 4 where there is illustrated secured to the end unit 16 yet another form of whistle device 40. The whistle device 40 is of the air stream splitting whistle type and is suitably bonded to the underside of the recessed panel portion 28 as at 42. The whistle device 40 functions in the same manner as the whistle devices 30 and 34, but may emit still another type audible sound.

It is to be understood that loudness, pitch and duration of the sound will be controlled by the size of the opening 18 and the whistle cavity. Opening diameters ranging from 0.100 inch to 0.170 inch have been evaluated with successful results.

It is to be understood that while only three types of whistle devices have been specifically illustrated and described, other types of whistle devices may be used. The type of whistle device to be chosen is based in part upon the amount of air flow necessary to actuate the whistle device and in part on the type of sound which is to be emitted. The cavity whistle 30 produces a sound similar to a tea kettle whistling; the vibrating reed whistle device 34 produces a sound similar to that of a harmonica reed; and the air stream splitting whistle device produces a sound similar to that of a referee's whistle.

Although only preferred embodiments of the invention have been specifically illustrated and described herein, it is to be understood that minor variations may be made in the container construction without departing from the spirit and scope of the invention as defined by the appended claims.

We claim:

1. An end unit attached to a vacuum pack container, said end unit including a flat panel portion with an opening therethrough, vacuum indicating means in the form of a whistle device on the underside of said flat panel portion in communication with said opening, and a removable closure secured to an upper side of said flat panel and normally closing said opening.

2. An end unit according to claim 1 wherein said whistle device is a cavity whistle.

3. An end unit according to claim 1 wherein said whistle device is a reed whistle.

4. An end unit according to claim 1 wherein said whistle device is an air stream splitting whistle.

5. An end unit according to claim 1 wherein said end unit is part of a sealed container having a product packed therein under sealed vacuum conditions.

6. An end unit according to claim 1 wherein said removable closure is a peelable tape at least in part releaseable from said panel portion to uncover said opening.

7. An end unit according to claim 6 wherein an end portion of said tape is permanently secured to said panel portion.

8. An end unit for a vacuum pack container according to claim 1 wherein said vacuum indicating means is actuated by removal of said removable closure.

9. A sealed vacuum pack container according to claim 5 wherein said vacuum indicating means is actuated by removal of said removable closure.

* * * * *